United States Patent [19]

Reynolds

[11] 4,119,288

[45] Oct. 10, 1978

[54] FIRE EXTINGUISHER SUPPORT

[76] Inventor: James T. Reynolds, 6 Holman Ave., Inver Grove Heights, Minn. 55075

[21] Appl. No.: 818,948

[22] Filed: Jul. 25, 1977

[51] Int. Cl.[2] ..... A47K 1/08

[52] U.S. Cl. ..... 248/313; 248/314

[58] Field of Search ..... 248/313, 310, 311.1, 248/311.3, 102, 103, 104, 314

[56] References Cited

U.S. PATENT DOCUMENTS

| | | | |
|---|---|---|---|
| 1,464,001 | 8/1923 | Iddings | 248/313 |
| 2,496,478 | 2/1950 | Kinnebrew | 248/103 |
| 2,834,566 | 5/1958 | Bower | 248/103 |
| 3,253,084 | 5/1966 | Taylor | 248/103 |
| 4,015,810 | 4/1977 | Williams | 248/311.1 |
| 4,030,690 | 6/1977 | Hanauer et al. | 248/104 |

*Primary Examiner*—Robert A. Hafer

*Attorney, Agent, or Firm*—Jacobson and Johnson

[57] ABSTRACT

A support for holding a fire extinguisher comprising a hollow elongated cylinder which has an opening extending lengthwise for insertion of a fire extinguisher. The inside dimensions and shape of the support closely conform to the outside dimension and shape of the extinguisher to securely hold the extinguisher within the support.

1 Claim, 4 Drawing Figures

FIG. 1
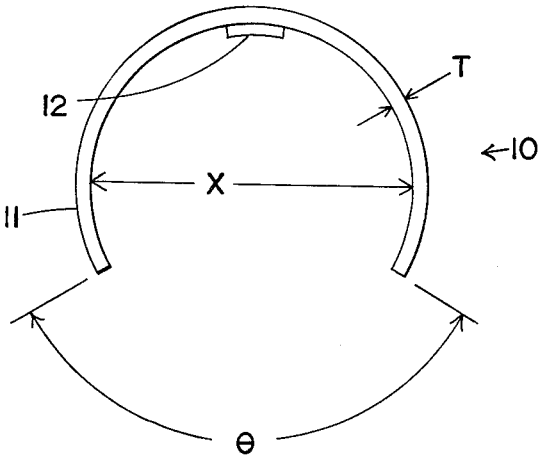
FIG. 3
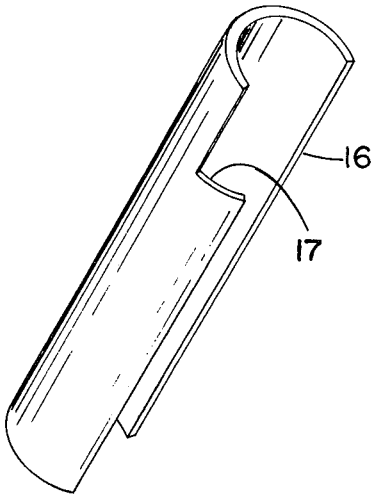
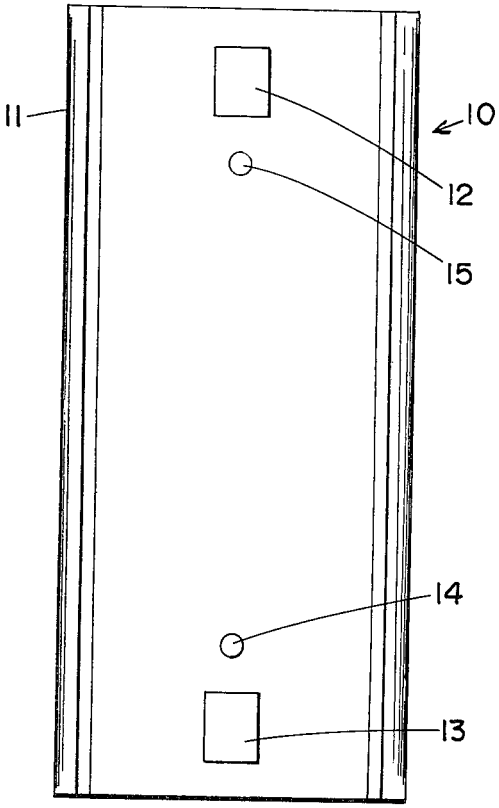
FIG. 2
FIG. 4
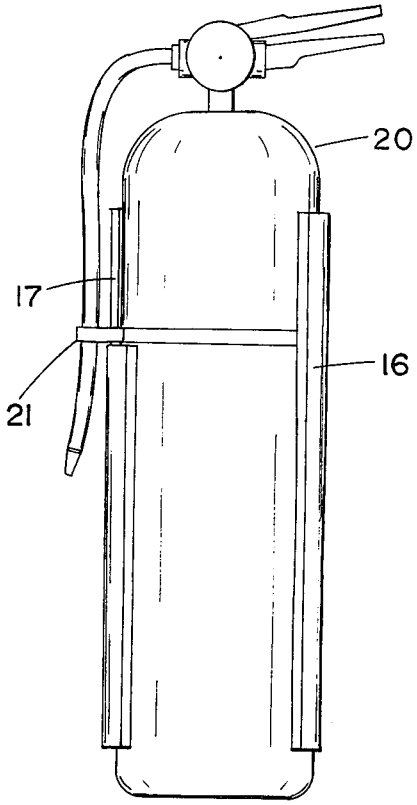

FIRE EXTINGUISHER SUPPORT

BACKGROUND OF THE INVENTION

1. Field of the Invention

This invention relates generally to supports and more specifically to supports for holding fire extinguishers.

2. Description of the Prior Art

The concepts of wall mounted support holders for fire extinguishers and the like are well known in the art. A typical holder for a cylindrical article is shown in Creevy U.S Pat. No. 3,768,634 which shows a clinical thermometer holder. The holder of Creevy comprises an integral body comprised of a flexible non-skid elastomeric or plastic material having side arms. The side arms of Creevy's holder are dimensioned so that the flexible body engages and grips a portion of the exterior of the cylindrical vial.

Another type of holder is shown in the prior art Tullos U.S. Pat. No. 3,644,933. Tullos shows a holder for an inking pen system which has a metal clip for partially encompassing and supporting an ink reservoir. The clip has a slightly smaller diameter than the ink container to provide the holding action.

Another support is shown in the Culver U.S. Pat. No. 3,215,388 for holding articles having flanges. Culver uses a leaf spring to engage and hold a can with a flange in a circular support.

These are general types of prior art holders used to hold miscellaneous cylindrical articles. An example of prior art holders used to hold fire extinguishers is shown in Paulus et al U.S. Pat. No. 1,918,191. Paulus shows a bracket that holds the top and bottom of an extinguisher as well as spring fingers which extend partially around the sides of the extinguisher.

Another type of prior art fire extinguisher holder is shown in Smith U.S. Pat. No. 1,297,024. Smith also shows a hanger which has spring tines for extending around the portion of the extinguisher as well as the top and bottom support for gripping the two ends of the extinguisher.

As evidence above, the prior art type of holding devices have similar basic structure to hold cylindrical objects. However, to securely and safely hold a fire extinguisher, it is necessary that the support be rugged, i.e., be able to withstand accidental blows. It is also important that the extinguisher holder bracket does not damage the extinguisher. It is further required that the bracket allow for removal and insertion of the fire extinguisher so that it can be readily replaced if necessary. The bracket should also be suitable for mounting on mobile units such as trucks, vans and tractors which are subject to vibration during operation. Also, the bracket should not corrode to prevent removal of the extinguisher.

BRIEF SUMMARY OF THE INVENTION

Briefly, the present invention comprises a hollow cylinder having a lengthwise opening for removal or insertion of the extinguisher. The walls of the support coact with a resilient pad to insure a pressure fit between the extinguisher and the holder. A further feature of the invention is that the outside diameter of the fire extinguisher is essentially the same as the inside diameter of the hollow cylinder so that the two dimensions coact to provide a firm support for holding a fire extinguisher.

BRIEF DESCRIPTION OF THE DRAWING

FIG. 1 is a top view of my fire extinguisher support;

FIG. 2 is a front view of my fire extinguisher support;

FIG. 3 is a perspective view of another embodiment of my fire extinguisher support; and FIG. 4 shows a fire extinguisher located in a fire extinguisher support.

DESCRIPTION OF THE PREFERRED EMBODIMENT

Referring to FIG. 1 and FIG. 2, reference numeral 10 generally designates a fire extinguisher support comprised of a hollow circular cylindrical member having an opening denoted by angle $\theta$. Preferably, cylinder 11 extends so as to cover 60 to 100% of the length of the fire extinguisher to thereby offer both support and protection. The opening extends lengthwise along and parallel to elements of hollow circular cylinder 11. Support 11 has an inside diameter X and a thickness T. Located on the back of support 11 is a set of resilient pads 12 and 13. Pads 12 and 13 may be a compressible foam material. In operation, pads 12 and 13 abut against the extinguisher cylinder to assist supporting the fire extinguisher in support 10. Mounting means 14 and 15 comprise a pair of openings for holding support 10 to a wall or a vehicle. Typically, screws or bolts may be used to hold support 10 to a wall or a vehicle.

Referring to FIG. 3, an alternate embodiment of the extinguisher support 16 is shown with a cutaway section 17. Section 17 provides a support surface for assisting in holding the larger extinguishers, i.e., the 10 lb. and larger extinguishers.

FIG. 4 shows a large extinguisher 20 vertically mounted in extinguisher support 16. The hose band support 21 which mounts to the fire extinguisher 20 to hold the hose against extinguisher 20 engages the transverse portion of section 17 to provide a firm support for extinguisher 20.

In order to understand the use of my fire extinguisher support, it should be noted that the nominal internal dimension of the fire extinguisher support is denoted by X. The dimension is substantially identical to the nominal outside diameter of the fire extinguisher. Typically, the nominal dimensions of support 10 and the extinguisher are 3, 4, 5 or 6 inches. The opening denoted by angle $\theta$ varies with the type and thickness of the material used. If support 10 is made from polyvinyl chloride (PVC), a suitable thickness T is ¼ inch. The angle $\theta$ can vary from 120° to 135°. If $\theta$ is less than 120° it is difficult to insert or remove the fire extinguisher from the support. If $\theta$ varies from 120° to 130° there is a firm support. If $\theta$ ranges from 130° to 135° there is sufficient support for most uses. If the angle $\theta$ is larger than 135° the support is generally too loose to securely hold the extinguisher. While the preferred polymer is polyvinyl chloride, other polymer plastic materials are suitable if proper compensation for holding forces are considered.

The opening denoted by $\theta$ has been described, however, it should also be noted that the pads 12 and 13 coact with hollow cylinder 11 to prevent the full engagement of the outer periphery of the fire extinguisher with the inner surface of support 10. That is, pads 12 and 13 prevent the extinguisher from fully engaging the inside of the cylindrical support 10. Therefore, in operation of support 10 it is the inner surface adjacent the sides of the opening and the pads 12 and 13 which coact to pressure engage the fire extinguisher therebetween.

Preferably, pads 12 and 13 are made from a compressible yet resilient material which will provide a cushioned support for the back of the extinguisher. When these type of pads are used with a plastic which is strong, durable and rigid, yet with enough flexibility to allow opening to permit insertion of the extinguisher, I have found my support will withstand a severe blow without damage.

Pads 12 and 13 can be of varying thickness and size, however, it has been found that if the total surface area of pads is about two square inches and the thickness of the pads is about ⅛ inch, very effective support is obtained.

While it is pointed out that pads 12 and 13 hold the extinguisher away from the rear portion of support 10, it is advantageous to have pads as thin as practical as this allows for greater surface contact between the inner surface of support 10 and the outer surface of the extinguisher.

I claim:

1. A fire extinguisher support comprising:

an elongated hollow cylindrical member having an inside surface and on outside surface with a nominal inside diameter of dimension X, said elongated hollow cylindrical member formed from a material characterized by flexibility for deforming to receive a fire extinguisher and sufficient resiliency so as to produce sufficient pressure to frictionally support a fire extinguisher therein;

said elongated hollow cylindrical member having an opening defined by an angle $\theta$ which ranges from 120° to 135°, said opening extending lengthwise for inserting a cylindrical fire extinguisher having a nominal outside diameter of dimension X; and a resilient pad mounted to said inside surface of said hollow cylindrical member, said resilient pad extending over a portion of the inside surface of said hollow cylindrical member so that when a fire extinguisher is placed in said hollow cylindrical member said resilient pad forces a portion of the surface of the fire extinguisher into pressure contact with a second portion of the inside surface of said hollow cylindrical member to thereby produce a frictional engagement of the fire extinguisher to said elongated hollow cylindrical member and thereby securely hold a fire extinguisher therein, said elongated hollow cylindrical member having a length which ranges from about 60 to 100% of the length of the fire extinguisher to thereby provide sufficient frictional force to hold a fire extinguisher therein.

* * * * *